US011234474B2

(12) United States Patent
Tephabock

(10) Patent No.: US 11,234,474 B2
(45) Date of Patent: Feb. 1, 2022

(54) PROTECTIVE HELMET LINER APPARATUS

(71) Applicant: Theron Tephabock, Fontana, CA (US)

(72) Inventor: Theron Tephabock, Fontana, CA (US)

( * ) Notice: Subject to any disclaimer, the term of this patent is extended or adjusted under 35 U.S.C. 154(b) by 113 days.

(21) Appl. No.: 16/777,500

(22) Filed: Jan. 30, 2020

(65) Prior Publication Data

US 2021/0235805 A1 Aug. 5, 2021

(51) Int. Cl.
*A42B 3/12* (2006.01)

(52) U.S. Cl.
CPC ..... *A42B 3/12* (2013.01); *A42B 3/121* (2013.01)

(58) Field of Classification Search
CPC ..... A42B 3/121; A42B 3/12; A42B 3/10
See application file for complete search history.

(56) References Cited

U.S. PATENT DOCUMENTS 3,039,109 A * 6/1962 Simpson ..... A42B 3/121 2/413
3,994,022 A * 11/1976 Villari ..... A42B 3/121 2/413
4,343,047 A * 8/1982 Lazowski ..... A42B 3/125 2/411
4,432,099 A * 2/1984 Grick ..... A42B 3/124 2/412
5,345,614 A 9/1994 Tanaka
6,032,300 A * 3/2000 Bainbridge ..... A41D 13/015 2/456
6,493,881 B1 * 12/2002 Picotte ..... A42B 1/08 2/413
8,856,972 B2 10/2014 Kirshon
2011/0107503 A1 5/2011 Morgan
2014/0325745 A1 * 11/2014 Erb ..... A42B 3/127 2/414
2015/0040296 A1 * 2/2015 Hanson ..... A42B 3/069 2/411
2015/0047110 A1 2/2015 Chilson
2015/0089721 A1 * 4/2015 Hanna ..... A42B 3/069 2/412
2017/0318891 A1 11/2017 Walterspiel
2018/0153244 A1 6/2018 Kirshon

* cited by examiner

*Primary Examiner* — Tajash D Patel

(57) ABSTRACT

A protective helmet liner apparatus for prevention of head injury, concussions, and brain trauma includes a liner body dimensioned such that a bottom edge sits below a user's skull and a front edge extends from behind the user's ears, over the ears, and across the forehead above the user's eyebrows. A shock-absorptive filling is coupled within the liner body between an inside and an outside of the liner body. A plurality of engagement members comprises a plurality of first engagement members coupled to the outside of the liner body and a plurality of second engagement members coupled to an inner side of a helmet. The first engagement members are selectively engageable with the second engagement members to secure the liner body to the helmet.

6 Claims, 5 Drawing Sheets

PROTECTIVE HELMET LINER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to protective devices and more particularly pertains to a new protective device for prevention of head injury, concussions, and brain trauma.

(2) Description of Related Art Including Information Disclosed Under 37 CFR 1.97 and 1.98

The prior art relates to protective devices worn on the head. Many known types of helmets exist and often include a liner for improved protection and user comfort. However, these existing liners often do not employ ample shock absorption and cannot be adapted to a variety of different helmets.

BRIEF SUMMARY OF THE INVENTION

An embodiment of the disclosure meets the needs presented above by generally comprising a liner body having an inside, an outside, a bottom edge, and a front edge. The liner body has a front portion, a top portion, a left portion, a right portion, and a back portion. The bottom edge extends horizontally from the left portion, along the back portion, to the right portion. The front edge extends from the bottom edge up at an angle from the right portion, along the front portion, to the left portion. The liner body is dimensioned such that the bottom edge sits below a user's skull and the front edge extends from behind the user's ears, over the ears, and across the forehead above the user's eyebrows. A shock-absorptive filling is coupled within the liner body between the inside and the outside. A plurality of engagement members comprises a plurality of first engagement members coupled to the outside of the liner body and a plurality of second engagement members configured to be coupled to an inner side of a helmet. The first engagement members are selectively engageable with the second engagement members to secure the liner body to the helmet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
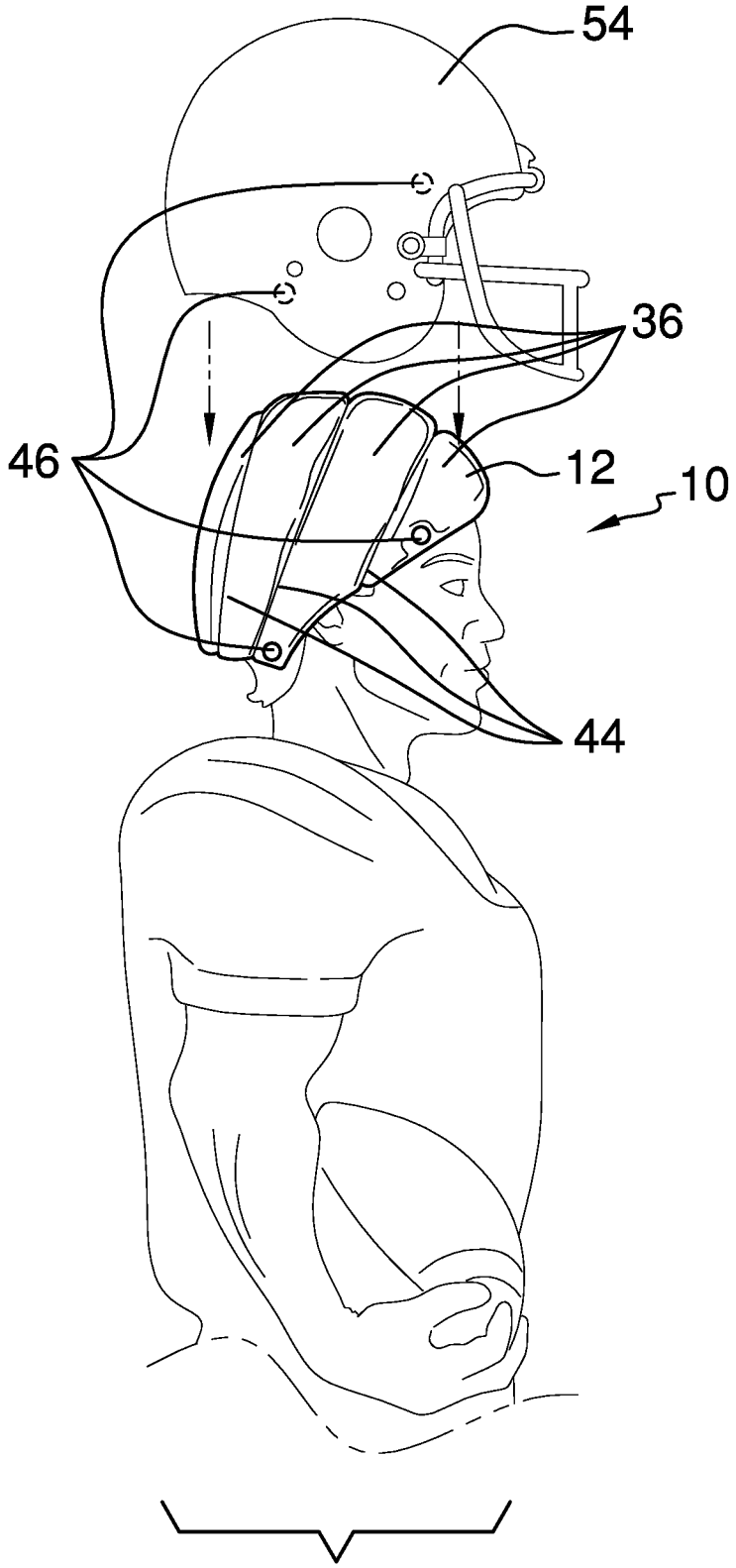
FIG. 1 is an in-use view of a protective helmet liner apparatus according to an embodiment of the disclosure.
Figure 2:
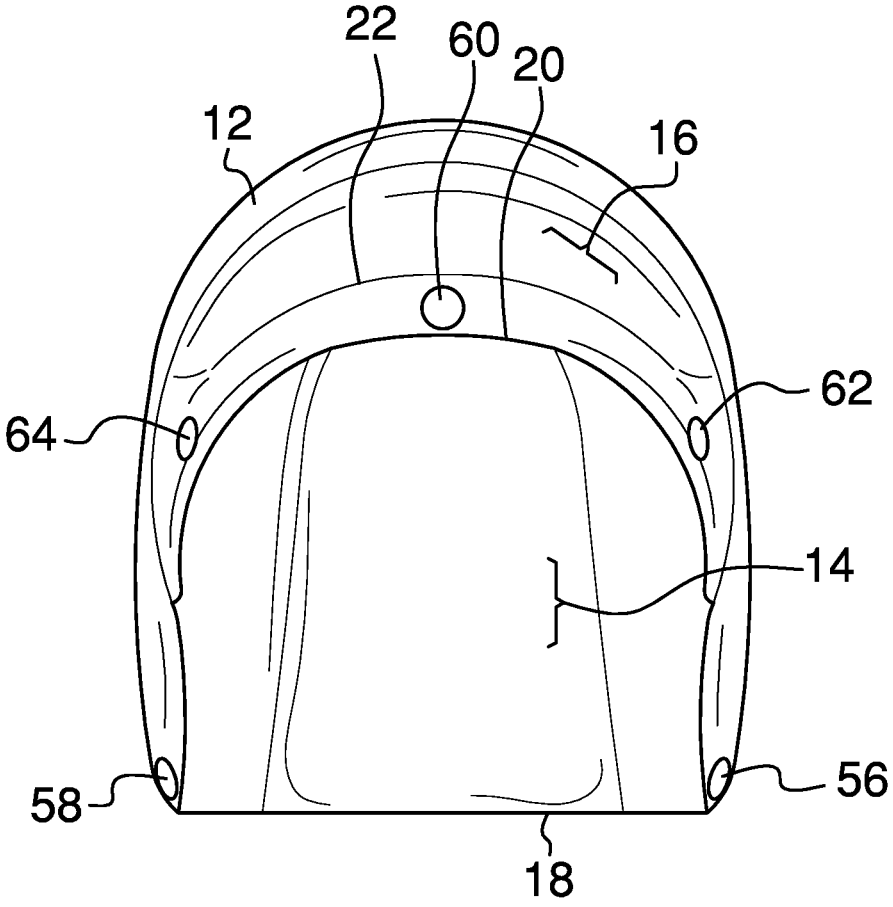
FIG. 2 is a front elevation view of an embodiment of the disclosure.
Figure 3:
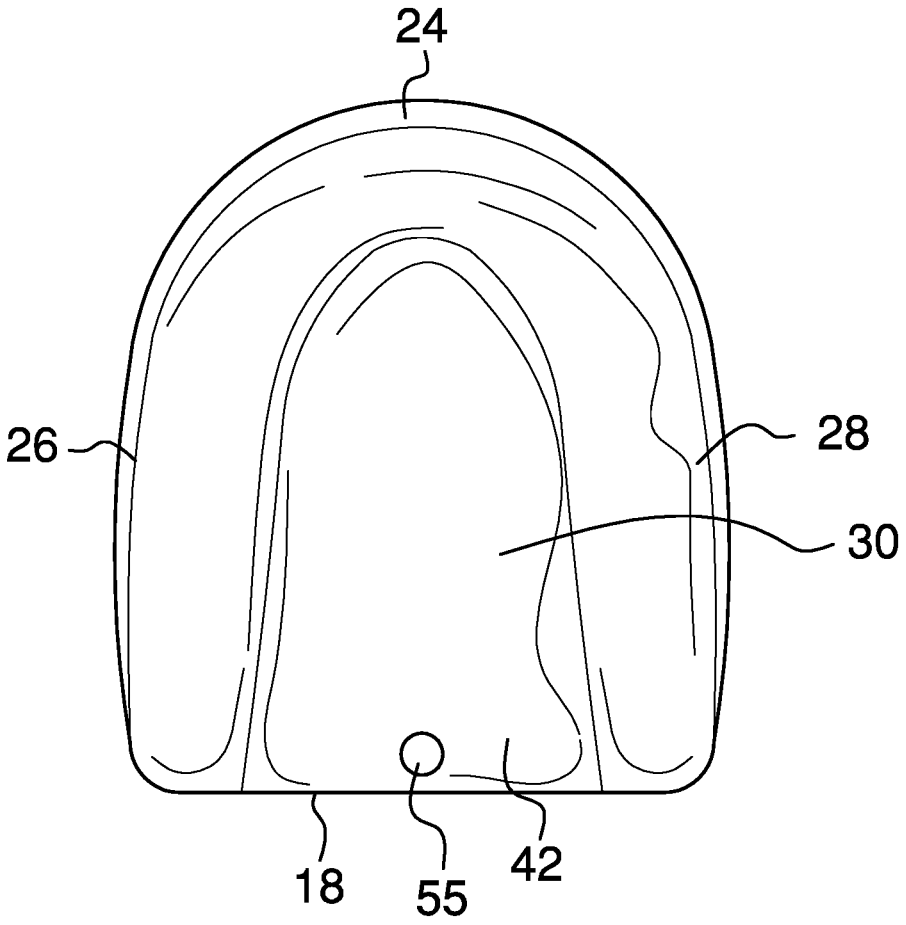
FIG. 3 is a rear elevation view of an embodiment of the disclosure.
Figure 4:
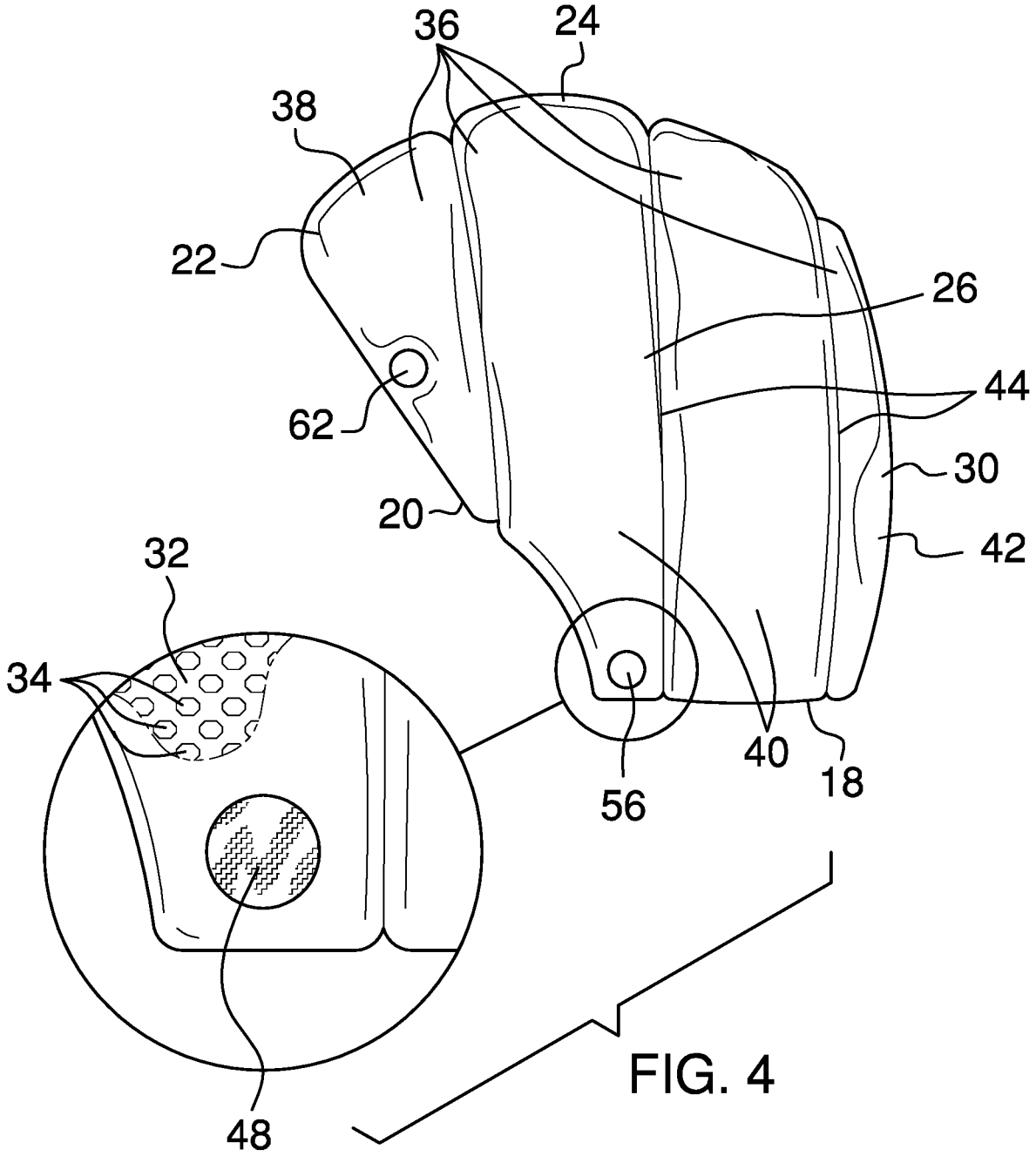
FIG. 4 is a side elevation view of an embodiment of the disclosure.
Figure 5:
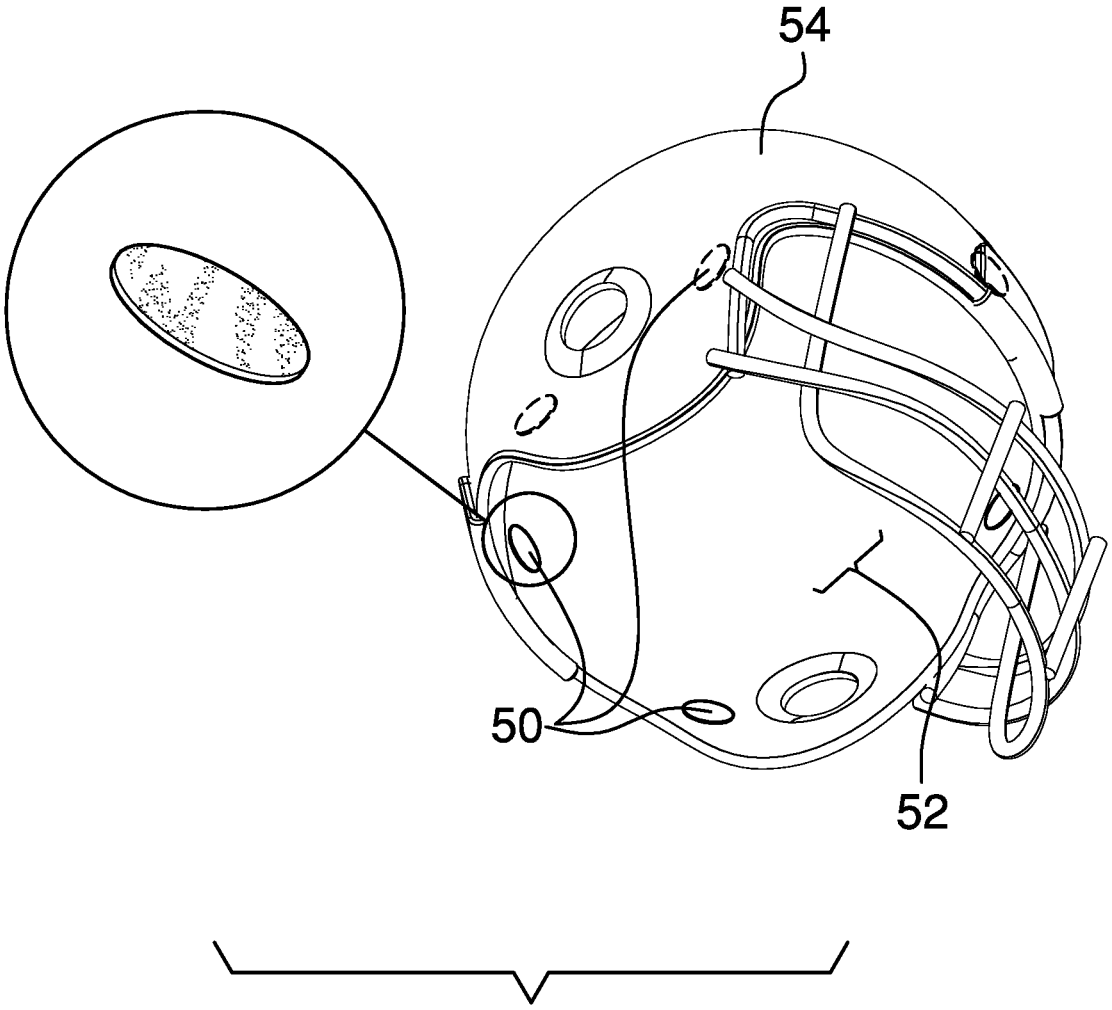
FIG. 5 is an isometric view of an embodiment of the disclosure.

With reference now to the drawings, and in particular to FIGS. 1 through 5 thereof, a new protective device embodying the principles and concepts of an embodiment of the disclosure and generally designated by the reference numeral 10 will be described.

As best illustrated in FIGS. 1 through 5, the protective helmet liner apparatus 10 generally comprises a liner body 12 having an inside 14, an outside 16, a bottom edge 18, and a front edge 20. The liner body 12 has a front portion 22, a top portion 24, a left portion 26, a right portion 28, and a back portion 30. The bottom edge 18 extends horizontally from the left portion 26, along the back portion 30, to the right portion 28. The front edge 20 extends from the bottom edge 18 up at an angle from the right portion 28, along the front portion 22, to the left portion 26. The liner body 12 is dimensioned such that the bottom edge 18 sits below a user's skull and the front edge 20 extends from behind the user's ears, over the ears, and across the forehead above the user's eyebrows.

A shock-absorptive filling 32 is coupled within the liner body 12 between the inside 14 and the outside 16. The shock-absorptive filling 32 may comprise a plurality of beads 34. The shock-absorptive filling 32 may further comprise a foam or gelatinous based medium in which to suspend the beads 34 and further increase the shock-absorptive abilities of the apparatus 10.

The liner body 12 may comprise a plurality of segments 36 including a front segment 38, at least two medial segments 40, and a back segment 42. There may be a pair of medial segments 40. Each segment 36 is compartmentalized from the adjacent segment to prevent uneven distribution of the shock-absorptive filling 32. The compartmentalization may be achieved by joining the inside 14 to the outside 16 along a plurality of seams 44. The back segment 42 occupies the back portion 30 of the liner body, the medial segments 40 occupy the left portion 26, the top portion 24, and the right portion 28, and the front segment 38 occupies the front portion 22.

A plurality of engagement members 46 comprises a plurality of first engagement members 48 coupled to the outside 16 of the liner body and a plurality of second engagement members 50 configured to be coupled to an inner side 52 of a helmet 54. The helmet 54 may be, but is not limited to, a football helmet, a bicycle helmet, a motorcycle helmet, or a combat helmet. The first engagement members 46 are selectively engageable with the second engagement members 50. The plurality of engagement members 46 may be selectively engageable fastener such as, but not limited to, snaps, hook-and-loop fasteners, and the like. Each engagement member 46 may be circular. The second engagement members 50 may have an adhesive side configured to adhere to the inner side 52.

The plurality of first engagement members 48 may comprise a rear engagement member 55 coupled to the back portion 30 proximal the bottom edge 18, a lower left engagement member 56 coupled to the left portion 26 proximal the bottom edge 18 and the front edge 20, a lower right engagement member 58 coupled to the right portion 28 proximal the bottom edge 18 and the front edge 20, a front engagement member 60 medially coupled to the front portion 22 proximal the front edge 20, an upper left engagement member 62 coupled to the front portion 22 proximal the left portion 26 and the front edge 20, and an upper right engagement member 64 coupled to the front portion 22 proximal the right portion 2 28 and the front edge 20.

In use, the second engagement members 50 are coupled to the inner side 52 of the helmet in locations corresponding to the placement of the first engagement members 46 on the liner body 12. The liner body 12 is then attached to the helmet 54 with the first engagement members 48 and the helmet 54 is then worn for its intended use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A protective helmet liner apparatus comprising:

a liner body having an inside, an outside, a bottom edge, and a front edge, the liner body having a front portion, a top portion, a left portion, a right portion, and a back portion, the bottom edge extending horizontally from the left portion, along the back portion, to the right portion, the front edge extending from the bottom edge up at an angle from the right portion, along the front portion, to the left portion, the liner body being dimensioned such that the bottom edge sits below a user's skull and the front edge extends from behind the user's ears, over the ears, and across the forehead above the user's eyebrows, the liner body comprising a plurality of segments including a front segment, a medial segment, and a back segment, each segment of the plurality of segments being compartmentalized from adjacently positioned segments of the plurality of segments to prevent uneven distribution of the shock-absorptive filling throughout the liner body;

a shock-absorptive filling coupled within the liner body between the inside and the outside; and a plurality of engagement members comprising a plurality of first engagement members coupled to the outside of the liner body and a plurality of second engagement members configured to be coupled to an inner side of a helmet, the first engagement members being selectively engageable with the second engagement members.

2. The protective helmet liner apparatus of claim 1 further comprising the shock-absorptive filling comprising a plurality of beads.

3. The protective helmet liner apparatus of claim 1 further comprising the medial segment being one of three medial segments between the front segment and the back segment, the back segment occupying the back portion of the liner body, the three medial segments each occupying a respective one of the left portion, the top portion, and the right portion, and the front segment occupying the front portion.

4. The protective helmet liner apparatus of claim 1 further comprising the medial segment being one of a pair of medial segments between the front segment and the back segment.

5. The protective helmet liner apparatus of claim 1 further comprising the plurality of first engagement members comprising a rear engagement member coupled to the back portion proximal the bottom edge, a lower left engagement member coupled to the left portion proximal the bottom edge and the front edge, a lower right engagement member coupled to the right portion proximal the bottom edge and the front edge, a front engagement member medially coupled to the front portion proximal the front edge, an upper left engagement member coupled to the front portion proximal the left portion and the front edge, and an upper right engagement member coupled to the front portion proximal the right portion and the front edge.

6. A protective helmet liner apparatus comprising:

a liner body having an inside, an outside, a bottom edge, and a front edge, the liner body having a front portion, a top portion, a left portion, a right portion, and a back portion, the bottom edge extending horizontally from the left portion, along the back portion, to the right portion, the front edge extending from the bottom edge up at an angle from the right portion, along the front portion, to the left portion, the liner body being dimensioned such that the bottom edge sits below a user's skull and the front edge extends from behind the user's ears, over the ears, and across the forehead above the user's eyebrows;

a shock-absorptive filling coupled within the liner body between the inside and the outside, the shock-absorptive filling comprising a plurality of beads;

the liner body comprising a plurality of segments including a front segment, three medial segments, and a back segment, each segment of the plurality of segments being compartmentalized from adjacently positioned segments of the plurality of segments to prevent uneven distribution of the shock-absorptive filling throughout the liner body the back segment occupying the back portion of the liner body, the three medial segments each occupying a respective one of the left portion, the top portion, and the right portion, and the front segment occupying the front portion; and a plurality of engagement members comprising a plurality of first engagement members coupled to the outside of the liner body and a plurality of second engagement members configured to be coupled to an inner side of a helmet, the first engagement members being selectively engageable with the second engagement members.

* * * * *